US005259160A

United States Patent [19]

Carannante

[11] Patent Number: 5,259,160

[45] Date of Patent: Nov. 9, 1993

[54] KNOT FOR THE CONNECTION OF PILLARS AND GIRDERS IN SPATIAL FRAMES IN METALLIC CARPENTRY

[75] Inventor: Biagio Carannante, Bacoli, Italy

[73] Assignee: Metalmeccania Carannante SpA, a part interest

[21] Appl. No.: 743,045

[22] Filed: Aug. 7, 1991

Related U.S. Application Data

[63] Continuation-in-part of Ser. No. 474,845, Sep. 24, 1990, abandoned.

[51] Int. Cl.[5] ..... E04B 5/19

[52] U.S. Cl. ..... 52/252; 52/253; 52/259; 52/260

[58] Field of Search ..... 52/252, 253, 259, 260, 52/650.1, 729

[56] References Cited

U.S. PATENT DOCUMENTS

| | | | |
|---|---|---|---|
| 1,461,891 | 2/1922 | Coney | 52/253 |
| 1,625,899 | 4/1927 | Lally | 52/260 |
| 2,834,196 | 5/1958 | Donahue et al. | 52/260 |
| 3,261,135 | 7/1966 | Knabe | 52/252 |
| 3,374,592 | 3/1968 | Cheskin | 52/260 |
| 4,211,045 | 7/1980 | Korumi et al. | 52/260 |
| 4,333,285 | 6/1982 | Koizumi et al. | 52/252 |
| 5,123,220 | 6/1992 | Simenoff | 52/252 |
| 5,174,080 | 12/1992 | Yoshimura et al. | 52/252 |

FOREIGN PATENT DOCUMENTS 549939 12/1957 Canada ..... 52/260

*Primary Examiner*—Carl D. Friedman
*Assistant Examiner*—Wynn Wood
*Attorney, Agent, or Firm*—Beveridge, DeGrandi, Weilacher & Young

[57] ABSTRACT

A knot for connecting pillars and girders includes a first member adapted to be mounted on a pillar, and a plurality of second members which are each adapted to be connected to a respective girder. The number of second members is equal to the number of girders to be coupled with the pillar. The first member is made up of an upper plate and a lower plate that are coaxial and vertically spaced with respect to each other. These plates each have a number of sides equal to the number of the girders that converge onto the knot. The first member has a first coupling. The lower and upper plates are vertically coupled to each other by joining tongues which have second couplings. The second member has first and second horizontal plates which are vertically spaced from each other, and these plates are provided with a third coupling that couples with the first coupling of the first member. The first and second plates are joined by a transverse vertical plate and a longitudinal vertical plate. The longitudinal vertical plate has a fourth coupling that couples with the second coupling.

14 Claims, 3 Drawing Sheets

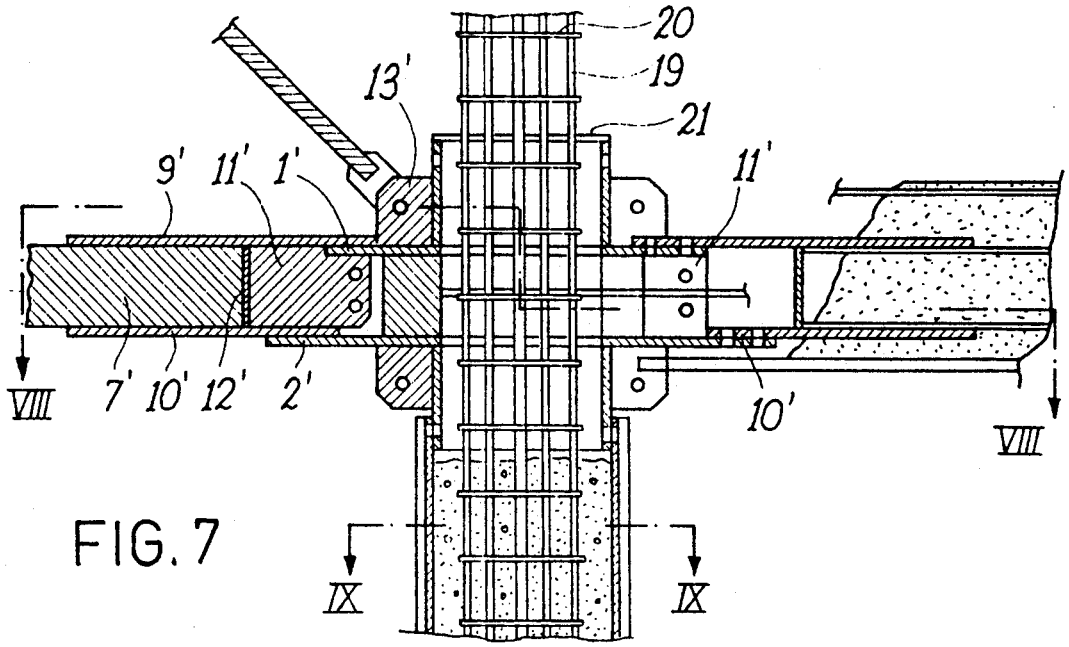
FIG. 7
FIG. 8
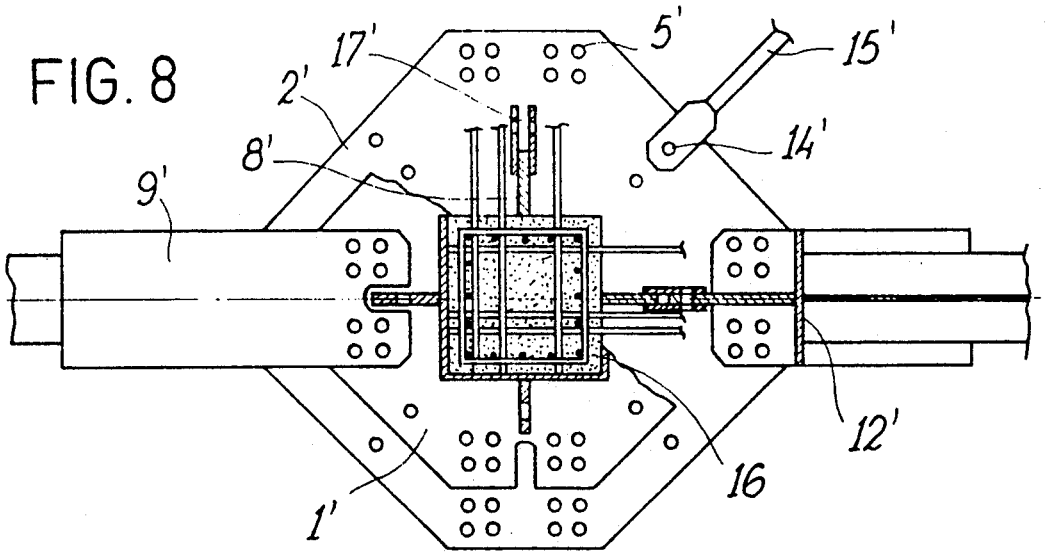
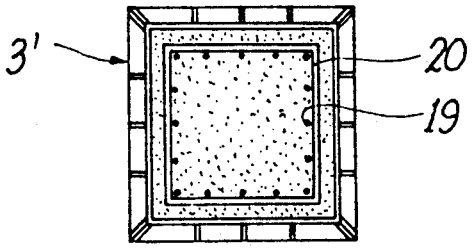
FIG. 9

KNOT FOR THE CONNECTION OF PILLARS AND GIRDERS IN SPATIAL FRAMES IN METALLIC CARPENTRY

REFERENCE TO RELATED APPLICATION

This is a continuation-in-part of U.S. patent application Ser. No. 07/474,845 filed Sep. 24, 1990, now abandoned.

DISCLOSURE OF THE INVENTION

The present invention relates to a knot for the connection of pillars and girders of spatial frames and/or of girders alone in metallic carpentry.

More particularly, the invention relates to a knot of the said type, suitable both for pillars and girders interrupted at the knot, and for pillars going through the knot and interrupted girders, that can be industrially produced and assembled in the yard.

In the technical report No. 11, "I collegamenti nelle strutture sismoresistenti di acciaio", by Prof. G. Ballio and Prof. F. M. Mazzolani, Publication of the Italsider, 1990, analyzing the results of dynamical and statical tests on nine-floor models to the scale of 1:6 carried out by SHAISHMELASHVILI and EDISHERASHVILI (URSS), one reads at page 11: "The comparative set of the dynamical characteristics obtained by such tests seems to indicate the scheme 7 as the most suitable of all"; where the the scheme 7 is the frame with chessboard braced grids. Again "As an outline, from the point of view of the increasing ductility, three classes of structures can be specified at the present day: 1. pendular structures with isolated braces provided by reticular brackets or with walls (or cores) in reinforced concrete; 2. frame stout structures, coupled with bracing members in steel or in reinforced concrete; 3. structures with frames having ductile rigid knots, i.e. so sized that plastic hinges can be created at the connection between girders and pillars".

A fourth class of structures can be added to the preceding ones, i.e. the structures with frames having ductile rigid knots with complete reset brace tie bars, soft metallic braces, i.e. elasto-plastic springs that damp wherever allowed by the architectural plan, so as to more or less approach the braced chessboard frame in order to have the most ductile and suitable structure with reference to the dynamical characteristics.

At the tenth Symposium C.T.A. 1985 (C.T.A.=Collegio Tecnici dell'Acciaio, piazzale Morandi, 2-20121, Milano) an experimentation has been presented by Eng. Besio, Eng. Corbani, Ing. Cremonini and Ing. De Martino on a "Sistema strutturale di giunti rigidi per trave colonna mediante staffe bullonate". At page 3 of the report one reads: "In the practice diffused till recent times it has appeared that, where particular architectural constraints do not exists, the solution by reticular braces or with reinforced concrete cores turns out to be more suitable than the equivalent one with rigid knots, in that the usual rigid connections, realized by welded joints or by flanged joints with the employment of high strength bolts are particularly burdensome owing to the low manufacturing throughput in the workshop and to the low assembly throughput in the yard. Again: ". . . the design aspect has been developed that has led to the definition of new jointing typology . . . ", at the end of the report the diagram of the novel jointing typology is reported.

From the above one can deduce that in the technical literature the framed scheme is considered to be the most suitable in antiseismic structures. However, such a scheme isn't utilized for metallic construction owing to the production and assembly complications that it involves.

The suggested knot according to the present invention is a rigid knot, which can provide vertical, oblique or horizontal braces and which can be industrially mass-produced in a simple and quick manner. The assembly of the knot turns out to be equally simple and quick, as well as safe.

It is therefore a specific object of the present invention a knot for connecting pillars and girders characterized in that it comprises a first member made up of an upper plate and of a lower plate that are coaxial, parallel to each other and vertically spaced, and have each a number of sides equal to the number of the girders that converge onto the pillar, which member being provided with first coupling means, the two lower and upper plates being vertically coupled with each other by means of jointing tongues provided with second coupling means; and a second member made up of two parallel horizontal plates, spaced from each other by a distance equal to the height of said girders, provided with third coupling means that couple with said first coupling means, and joined by a transverse vertical plate, so as to define a coupling zone between the girder and the second member, and by a longitudinal vertical plate, extending in a direction opposite the one of the coupling of the second member to the girder, and provided with fourth coupling means that couple with said second coupling means; the number of second members provided on the knot being equal to the number of the girders that are to be coupled to the pillar.

Again according to the invention, said two lower and upper plates of the first member are structurally separated, have equal sizes and are each provided with two substantially central, vertical angular tongues opposite to each other that space the two plates vertically. Preferably, the two horizontal plates of the second member are dimensionally equal to each other.

In a second embodiment of the knot of the invention, said first knot provides a central hole for the passage of the pillar, and is comprised of a lower plate larger than the upper one and connected thereto by means of vertical jointing tongues arranged outside said hole in a number at least equal to that of the girders.

In particular as many jointing tongues as knot converging girders are provided.

Preferably, said jointing tongues are each comprised of two vertical surfaces parallelly spaced from each other so as to allow said longitudinal vertical plate of said second member to be inserted.

Further, the lower horizontal plate of the second member is longer than the upper one, so that it is able to correctly couple to the lower and upper plates of the first member.

Again, according to the invention, said lower and upper plates of the first member have as many sides as said second members are, and each is provided with said first coupling means.

Preferably, said first, second, third and fourth means for coupling are comprised of holes which bolts are inserted into.

Under the hypothesis of the reinforced concrete pillar, said third and fourth means for coupling will be preferably realized from reinforced concrete.

The knot according to the invention can, moreover, provide, on said lower and upper plates of the first member, fifth coupling means for the coupling of horizontal, oblique and vertical braces, and sixth coupling means for the coupling of braces, preferably comprised of holes which bolts couple with.

The present invention will be now disclosed according to preferred embodiments thereof with particular reference to the figures of the annexed drawings, in which:

FIG. 7 is a partly sectioned elevation view of a third embodiment of the knot according to the invention;

FIG. 8 is a plan view of the knot of FIG. 7, partly sectioned along the line VIII—VIII, and FIG. 9 is a section along the line IX—IX of FIG. 7.

Figure 1:
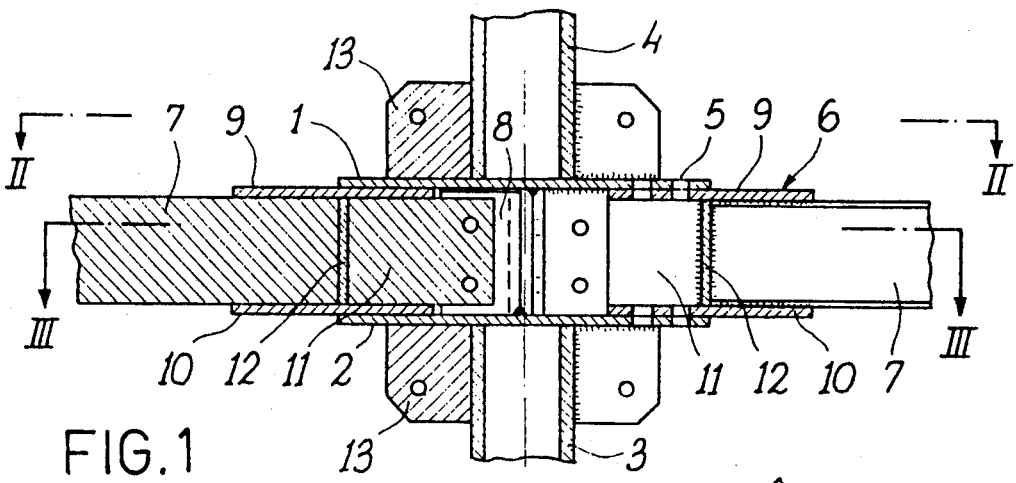
FIG. 1 is a partly sectional elevation view of a first embodiment of the knot according to the invention.
Figure 2:
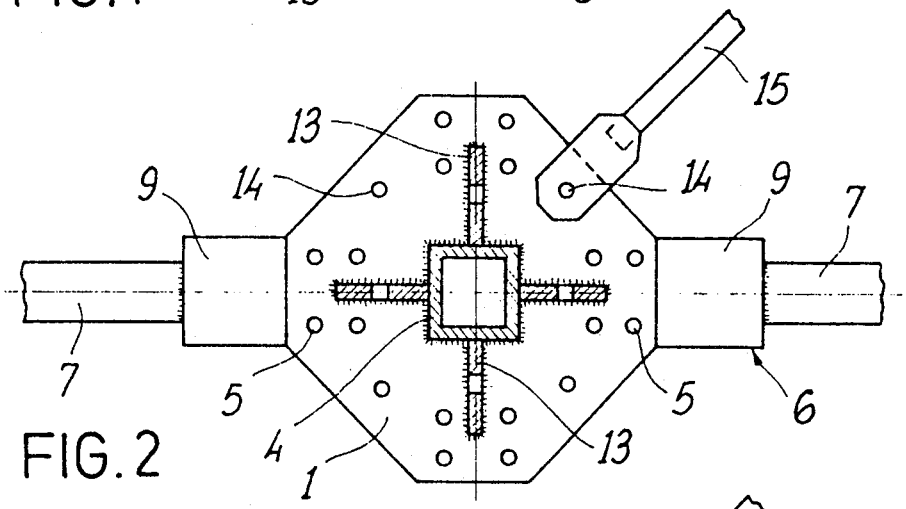
FIG. 2 is a top plan view of the knot of FIG. 1, partly sectioned along the line II—II.

With reference first to FIGS. 1 to 4, a knot is presented according to the invention for girders and interrupted pillars.

The knot shown in FIGS. 1 to 4 provides two parallel plates 1 and 2, arranged, respectively, at the upper extremity of a pillar 3 and at the lower extremity of a pillar 4, making up, in the whole, the abovementioned first member of the knot.

Said two plates each provide four drillings 5 suitable for the coupling with corresponding drillings provided on the second member 6 of the knot, by means of bolts.

Therefore, four members 6, each one of which is coupled to a metallic girder 7 will couple on the plates 1 and 2 in the preferred embodiment represented in the figures.

Figure 3:
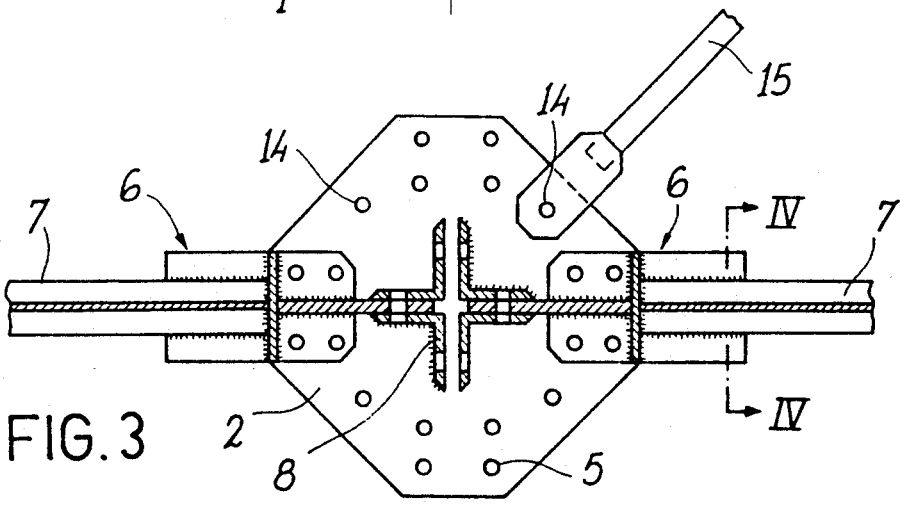
FIG. 3 is a top plan view of the knot of FIG. 1, partly sectioned along the line III—III.
Figure 4:
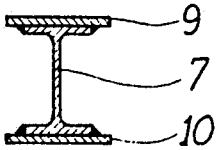
FIG. 4 is a section along the line IV—IV of FIG. 3.

The two plates 1 and 2 provide each two tongues 8, opposite to each other, on their inner surface facing the other plate, such that when the two plates stay at 90° to each other, as can be observed in FIG. 3;

Each of the members 6 is made up of two parallel horizontal plates 9, 10 provided with a drilling that mates with the drilling 5 of the plates 1 and 2, of a vertical plate 11, arranged longitudinally between said plates 9 and 10, that projects beyond them so as to mate, through a proper drilling, with the corresponding tongue 8 of the plates 1 and 2, and of a vertical plate 12, transverse between the two plates 9 and 10, that realizes the measure and the partial or total connection for the girder 7, besides a reinforcement against torsion.

A third member can be further provided on the plates 1 and 2, having one or more pierced tongues 13 to couple oblique braces (not shown) and holes 14 to couple horizontal braces 15.

The two plates 1 and 2 are to be connected to the pillars 3 and 4, while members 6 are to be welded to girders 7.

Figure 5:
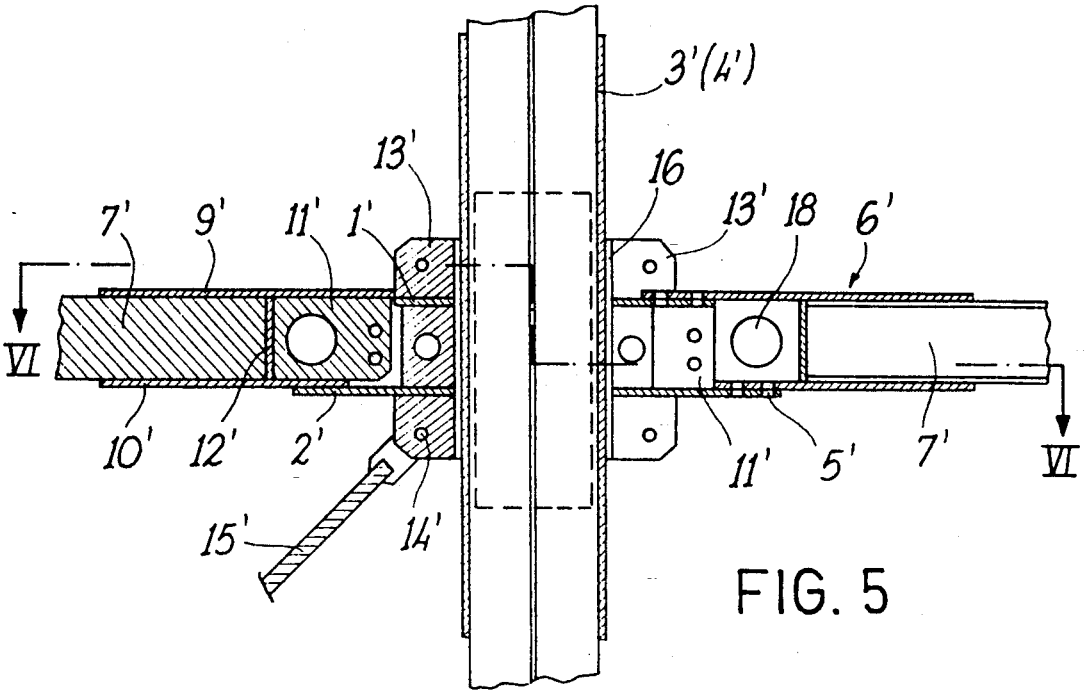
FIG. 5 is a partly sectioned elevation view of a second embodiment of the knot according to the present invention.
Figure 6:
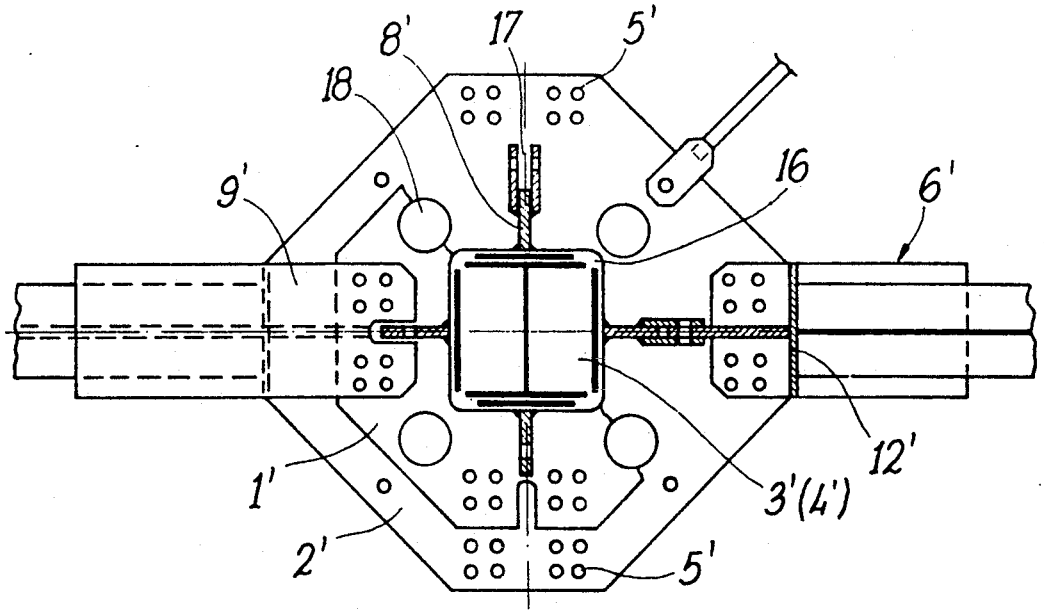
FIG. 6 is a plan view of the knot of FIG. 5, partly sectioned along the line VI—VI.

In the solution represented in FIGS. 5 and 6, the first member of the knot according to the invention is made up of two plates 1' and 2', parallel to each other, by means of the vertical tongues 8'.

The plates 1 and 2 have a central hole 16 for the passage of the pillar 3' (4'), which in this case is a through-pillar.

The upper plate 2' in this case is narrower than the lower plate 1'. Both plates 1' and 2' provide drillings 5'.

Members 6' are substantially the same as members 6 of the solution represented in FIGS. 1 to 4, in that they provide, also, two parallel, horizontal plates 9' and 10', a vertical longitudinal plate 11' and a vertical transverse plate 12'.

However, in this instance, as the plate 1' is narrower than the plate 2', the plate 9' of the member 6' will have to be necessarily longer than the plate 10' in order to be able to couple with the drilling 5'.

The vertical tongues 8' that connect the plates 1' and 2' present a groove 17 which the plate 11' of the member 6 inserts into.

Also this embodiment of the knot may present holes 14' for horizontal braces 15' and pierced tongues 13 for oblique vertical braces 22.

Holes 18 for the permeability of the plants are also provided.

This type of knot is inserted through the pillar 3' (4') by, e.g., 12 meters, positioned at the desired height making the axes of the nodes to coincide with the axes of the pillar 3' (4') and at right angles to it, or not, if an inclined scaffolding is dealt with, they are to be clamped by workshop welding. The usual error of the centering and clamping of the pillar 3' (4') of the knot, doesn't cause damage to the connection of the pillars with the girders 7', in that the measures are to be taken from the axes of the knot that aren't affected by the eccentricity of the positioning of the pillar in the knot. This type of knot is suitable for any type of structure. The anchorage of the first knot member to the pillar 3' will be made by workshop welding, and, in the hypothesis that the pillar has rolling tolerances, by changing the positioning play and the thickness of possible plates for reinforcing the pillar 3' of the knot, one succeeds in overcoming such a tolerance.

In FIGS. 7 to 9 the solution for a through pillar in reinforced concrete and metallic box acting as a recoverable temporary pillar.

Substantially, the knot is realized with the same characteristics of the embodiment according to FIGS. 5 and 6, whereby the coincident members are referred to with the same numerals. This knot allows, building the metallic boxes of the bearing pillars and computing them as the rods of a casting holder frame, the reinforced concrete pillar to be inserted into the knot. The metallic cage of the reinforced concrete, made up of the longitudinal bars 19 and of the brackets 20, will interest half of the lower floor and half of the upper floor and will be inserted at each scaffolding. The metallic box 21 may have any section, such as a square, a circle, an octagon, etc., section, and may also make up the external finishing of the pillar 3' (4') and act as a framework for the pillar itself, leaving to the reinforced concrete metallic cage the task of connecting the lower and the upper pillars and the task of reinforcing the restrained joint.

Naturally, by making the hole 16 in the upper plate 1' smaller, one readily effects the tapering of the pillars. It is to be observed that according to the theory and in opposition to the practical technique of the reinforced concrete, the overlapping of the frameworks is made at the center of the pillar 3', and not at the foot thereof, with a possibility for decreasing the number of frameworks departing from the knot. The knot according to the present invention can provide that the metallic box 21 of the reinforced concrete pillar 3' (4') isn't recovered. One goes back again to the solution of FIGS. 1 to 4, in which instead of positioning the tongues 8 one realizes the central hole 16 as in FIG. 8 for positioning the reinforced concrete metallic cage 19–20. The longitudinal bars 19 and the brackets 20 in this case substitute for the coupling realized by the tongues 8. In this embodiment of the knot, the iron tube is interrupted in the knot and welded to the plates 1 and 2 such as in FIGS. 1 and 2, while the reinforced concrete pillar of FIGS. 7 and 8 is passing through the node and the metallic box 3' of FIG. 9 is not recoverable as it is in the welded situation represented in FIGS. 1 to 3 and makes up the external finishing of the iron-reinforced concrete mixed section pillar. The utilization of these knots allows a metallic embodiment of the reinforced concrete.

Utilizing the knots according to the invention, the metallic skeleton of the construction, once assembled, will be a spatial structure made up of different braced or not braced vertical plane frames, and of different horizontal and/or sloped and/or curve, braced or not braced plans frames.

By producing and introducing into the market a series of this novel member, the bolted knot, to be reported in the manuals as is done for the whole production of iron and steel industry, one will obtain the following advantages:

1) even the most modest workshop for the simplicity of operation will be induced to realize its structures utilizing the prefabricated knot, and will be unconsciously obliged to follow the braced framed scheme, which is the most suitable for metallic structures in that the only operation that it will have to perform will be that of unscrewing the bolts, dividing the complex member into its elementary parts and welding in the workshop the first member close to the pillar or pillars, and the second member close to the extremities of the girders. The only manufacturing required for the rods is their cutting to measure. All the construction defects are thus eliminated at the source, starting from the calculation theoretical scheme, directing the structures towards regular shapes, first antiseismic rule. Also the welding of the rods to the knot in the workshop is preguided, in that for the girders the complete restore welded joint is provided also with a welding of not an excellent quality and in any case checkable in the workshop before the utilization. And the workshop can also be movable and operational within the yard itself, with a consequent saving in the transport of the structural members.

2) Having at disposal the prefabricated knots, any structure is designed, reckoned and realized in a short time being susceptible of a computerized programming.

3) The process is independent of the rolling tolerances in that the rolled rod is inserted into the knot, through pillar or girder extremity and is connected thereto with a welding, also interposing adapters in case of necessity. The precision of the assembly will be defined by the bolted prefabricated joint realized in a specialized environment and by the positioning axis/axes of the nodes.

4) Cantilevers can be easily realized.

5) For the rods of the frame, besides the maximum configuration that the knot is able to receive, one can utilize all other smaller bars, with the only adaptation of the knot by welding the girders 7 only to the plate 12 limiting the length of the plates 9 and 10 to the plate 12 and, by realizing the plate 12 to a greater size, one succeeds in inserting any kind of rod at any angle.

6) If into the first member of the knot a lower number of rods converge, it suffices to cut off the portion of the knot that is not of interest.

7) By changing the size of the knot, it is possible to utilize more rigid bars at the lower floors and less rigid at the upper floors, with the optimization of the material and consistently with theoretical calculation.

8) Likely, the steel structure with the employment of these knots will be able to turn out to be competitive with reinforced concrete, in that with them, contrary to reinforced concrete, one succeeds in cheaply realizing tie rod braces. Which braces by considerably taking up the stresses due to seismic actions, alleviate the remaining portions of the structure.

9) The employment of the knot, will increase the constructions in steel, favouring iron and steel industry and the population which will be provided with constructions more safe from the seismic point of view.

10) With the employment of the knot one will have, under the same conditions, a reduction of the weight of the structures, the uniformity of the heights of the girders with a consequent greater productivity; isolated braces will not exist and therefore there will not be any stress concentration, with consequent savings in the realization of the groundworks and of the braces themselves/and a quicker assembly. Finally, the structure will be more tasteful.

11) The tedious calculation of the jointing of the rods of the frame is eliminated, with the consequent elimination of error possibility, that stage being dealt with in a specific way at the time of determining the prototype of each knot to be mass-produced.

As we have seen, the state of the art realizes the framed steel structures only when it is obliged by architectural exigencies or by structural exigencies such as those of the sky-scrapers; and usually the entirely workshop welded knot is used because the known bolted joints are not practical to be realized and succeed with difficulty in realizing a complete restore connection of the weaker structural member. For example the flanged fixed joint knot, the most used in the practice and considered to be "the most efficient from a statical point of view", as indicated in Italsider's Publication, reissue 1979, "I collegamenti nella carpenteria metallica", page 58, has the drawback of drilling the column and thus of weakening it at the maximum moment point, that is to say at the point where a reinforcement is needed. The typology of the present knot, on the contrary, provides a connection welded in the workshop on a reinforced column. It is to be precisely stated that the reinforcement of the usual metallic bars is timely, because, as framed structures are dealt with, the moment has a zero point in the center of the pillar and a maximum value at the knot, and again because usually each pillar belongs to two plane frames at right angles to each other and therefore it is necessary to give the pillar a good strength to bending also in the weakest direction. This reinforcement has to be such that, once seismic forces have produced the yield of the vertical braces and thus the displacement of the scaffolding and with it the produced moments begin to be considerable, plastic hinges are created at the extremity of the girders and not at the extremity of the pillars which would yield the collapse of the entire structure.

The reinforcement of the pillar at the knot is useful besides for structural calculation reasons, also for correcting the rolling defects of the through pillar which by definition has to pass through the hole and has to be welded along its contour. The hole can be exactly defined for each bar: in fact, by changing the play between the plates and the pillar, e.g.: Italian Regulations between 0 and 3 mm, for plates greater or equal than 10 mm, one succeeds in limiting a rolling tolerance for the pillars of 3 mm×4 weldings=12 mm; i.e. one succeeds in overcoming the tolerance of the rolling for all the pillars, HE, with the exception of HEM. 0.500 pillars. In this case it will be necessary to change also the thickness of the reinforcement plates, and this is valid in that if the rolled bar is smaller than the theoretical, i.e. calculated, one, it is timely to reinforce the section with plates of an increased thickness, and vice-versa in the opposite case.

The plastic strain of vertical braces first and then of the extremities of the girders has to dissipate the kinetic energy transmitted by the earthquake to the construction, avoiding the collapse of the same or, in case, allowing the construction to be evacuated before its collapse. Coming back to the drawbacks of the flanged knot, another drawback is the fact that the connecting bolts are arranged at increasing distances from the point where the girder transmits to the pillar the tensile stress and therefore the bolts being not all engaged in the same way the breaking of one row of bolts at a time can occur. The strains of the bolts before breaking cause a positive effect for the ductility of the knot, but it cannot be said that ductile rigid knots are created, because the dissipation of energy in the bolts before reaching the collapse is very low.

The suggested bolt, on the contrary, allows both anelastic strains in the bolted joint with ovalization of the holes (plastic strains in the connected plates) and the creation of the plastic hinge proper. Contrary to the flanged solution, with the ovalization of the holes the bolts work all simultaneously and in the same way and the energy dissipation occurs in the plates and not in the bolts. It is timely to refer the following, found in the monograph 5 "Indagine Sperimentale sulla Resistenza e Duttilita di Collegamenti Strutturali", research of Italsider -Comunita Europea, July 1981, Genova. In the pages 42/43 in the conclusion of the experimentation on the vertical bracing cross latticework brace knot one reads: "The behaviour of the bolted joint is dominated by the slips, which however do not appear to be casual, and which in any case cause positive effects, in fact they contribute to a considerable measure to the ductility of the knot and therefore improve the dynamical response of the system", and again: "The structural ductility of the bolted jointing under these conditions turns out to be not less than that of the completely welded solution.", having realized the connection plates for a complete restore.

Speaking about the welded solution: "However, besides considerable execution complications related to the obligation to weld in the workshop, it presents a lower energy dissipation, there isn't a substantial contribution to the ductility of the knot, and the response under seismic actions appear to be less progressive than that of the bolted joint." And finally: "The tests with increased diameter bolts, M20, show generally how an oversizing of the bolts has positive aspects at the level of the strength, though it doesn't reduce ductility characteristics; in fact, moments are reached greater by about 10% than those observed with bolts M14, with sensibly higher rotations to break. Obviously, also the energy dissipation in the hysteresis cycle turns out to be sensibly increased".

The suggested knot favours the creation of plastic hinges where the passage occurs between the cross-section of the bar and the knot. In fact at this point, besides proportioning the girder for a moment nearly equal to that at the center and much less than the fixed jointing maximum moment, which the sizing of the flanged jointing girder has to be subjected to, a sudden strength decrease corresponds to a continuous variation of the stress.

Another advantage of the suggested bolt is the one that makes the assembly in the workshop with the descent of the girder from above easier. That is to say the girder is made to descend with a crane, and guided in its own site is automatically positioned and cannot fall, because besides resting on the portion of the knot close to the pillars, the second member of the knot is prevented from horizontally displacing.

The last advantage with respect to the flanged solution is that of not welding plates inside the pillar for restoring the continuity of the girder that passes through the knot, because this continuity is realized by the knot itself exteriorly of the pillar.

Analyzing the jointing typology annexed to the report of Ing. Besio, Ing. Corbani, Ing. Cremonini and Ing. De Martino, it provides brackets to be bolted near the pillar, the cross-sections of the unreinforced bars to be bolted near the brackets and the packing with butt straps. This assembly besides drilling girders and pillars doesn't provide the reinforcement of the girders and of the pillars in the knot, doesn't provide braces, doesn't provide a large bolting and is made up of too many members. To realize the assembly with the suggested joint, on the contrary, a worker in the workshop at the floor (x) has to be provided only with bolts, nuts, washers and implements for centering holes and tightening bolts, and hasn't to be also provided with brackets, plates and butt straps, which are heavy and cumbersome.

The most utilizable knot configuration provides that the lower pillar and the upper one, four girders at right angles to each other, four or eight oblique vertical braces and four horizontal braces converge into it; and however utilizing the same type of assembly, knots can be realized that provide the converging of a different number of girders or at a different angle, as well as of girders of different heights into it. The different both horizontal and vertical slope can be also obtained by welding the first member to the pillar obliquely and welding the girders obliquely to the second member.

The present invention has been disclosed with specific reference to preferred embodiments thereof, but it is to be understood that variations and/or modifications can be made by those skilled in the art, without departing from the scope of the enclosed claims.

We claim:

1. A knot for connecting girders to a pillar, comprising, a first member which is connectable to a pillar, and a plurality of second members which are each connectable to a respective girder, said first member including an upper plate, a lower plate, first coupling means, and connecting tongues which vertically couple the upper and lower plates; said connecting tongues having second coupling means;

each said second member including a first plate, a second plate, a transverse vertical plate, and a longitudinal vertical plate; said first and second plates being spaced apart and being provided with third coupling means for coupling with said first coupling means to couple the first and second members together, said longitudinal vertical plate being on an opposite side of said transverse vertical plate from the respective girder, said longitudinal vertical plate having fourth coupling means which couples with said second coupling means.

2. A knot according to claim 1, wherein the lower and upper plates of the first member are structurally separate pieces having a same size, each of said lower and upper plates being provided with two vertical connecting tongues which vertically space the lower and upper plates, said connecting tongues on each upper and lower plate being substantially centrally located and being opposite to each other.

3. A knot according to claim 1, wherein the lower and upper plates of the first member are structurally separate pieces having a same size, each of said lower and upper plates being provided with a central hole for the passage of a reinforced concrete pillar; said lower and upper plates of the first member being spaced by their coupling to the second members, said third and fourth coupling means being coupled by reinforced concrete of the pillar.

4. A knot according to claim 1 wherein the first and second plates of the second member have the same size.

5. A knot according to claim 1 wherein, said first member has a central hole for the passage of the pillar, said lower plate being larger than the upper plate and being connected thereto by vertical tongues arranged outside said hole in a number at least equal to the number of girders.

6. A knot according to claim 5 wherein there are four connecting tongues.

7. A knot according to claim 5 wherein the upper plate of the first member has grooves for receiving said longitudinal vertical plate of said second member.

8. A knot according to claim 5 wherein the connecting tongues each have two parallel vertical surfaces spaced from each other to provide a space which receives the longitudinal vertical plate of said second member.

9. A knot according to claim 5 wherein the first and second plates of the second member are horizontal, and the second plate is below the first plate, said second plate being longer than the first plate so as to couple correctly with the lower and upper plates of the first member.

10. A knot according to claim 1, wherein said lower and upper plates of the first member have four edges, each of which is provided with a said first coupling means.

11. A knot according to claim 1, wherein said first, second, third, and fourth coupling means includes bolt-receiving holes.

12. A knot according to claim 1, wherein said upper and lower plates of the first member are provided with fifth coupling means for coupling to horizontal braces and sixth coupling means for coupling to oblique vertical braces.

13. A knot according to claim 12, wherein the fifth coupling means includes bolt-receiving holes.

14. A knot according to claim 1 wherein the first and second plates are horizontal.

* * * * *